United States Patent [19]

Sakonishi

[11] 4,359,956

[45] Nov. 23, 1982

[54] APPARATUS FOR TOE CLOSURE OF HOSIERY

[75] Inventor: Tatsuo Sakonishi, Kohriyamashi, Japan

[73] Assignee: Tomotake Nakahira, Yamatotakadashi, Japan; a part interest

[21] Appl. No.: 92,836

[22] Filed: Nov. 9, 1979

[30] Foreign Application Priority Data

Nov. 11, 1978 [JP] Japan ..... 53/139205

[51] Int. Cl.[3] ..... D05B 1/00; D05B 7/00; D05B 27/00

[52] U.S. Cl. ..... 112/262.2; 112/121.15; 112/27; 112/262.3; 112/304

[58] Field of Search ..... 112/27, 25, 26, 262.1, 112/121.15, 304, 262.2, 262.3

[56] References Cited

U.S. PATENT DOCUMENTS

| | | | |
|---|---|---|---|
| 2,948,240 | 8/1960 | Burd et al. | 112/27 X |
| 3,450,075 | 6/1969 | Bridgeman | 112/27 |
| 3,487,797 | 1/1970 | Peloggio | 112/27 |
| 3,834,331 | 9/1974 | Raisin et al. | 112/27 |
| 4,174,670 | 11/1979 | Birkhamshaw | 112/25 |

*Primary Examiner*—H. Hampton Hunter
*Attorney, Agent, or Firm*—Thomas R. Morrison

[57] ABSTRACT

Knit hose are successively fed in a suspended position with their toe portions on top, to a first station at which the odds and ends of the toe portions are individually removed thereby to align the end lines of the toe portions. The hose are conveyed to a second station where the toe portions are individually closed by first linking, stitching and finally the hose are conveyed to a third station at which the first linking stitches are covered with second linking stitches.

4 Claims, 6 Drawing Figures

APPARATUS FOR TOE CLOSURE OF HOSIERY

BACKGROUND OF THE INVENTION

1. Field of the Invention

This invention relates generally to the toe closure of circular knit hose to produce hosiery, such as stockings and socks. More particularly, the invention relates to a method and apparatus for closing the toes of circular knit hose by linking without the necessity for a high degree of experience and skill.

2. Description of Prior Art

Conventionally, a circular linking machine is employed for toe closure, in which it is initially required to insert the point of the machine into each loop of the toe portion of knit hose. This is an extremely time- and labor-consuming operation. In addition, when the type and size of yarn differs from product to product, the point may not fit the needle, thereby requiring the replacement of the point. Also, if a thick yarn is applied to a point adapted for a thin yarn, the tip of the needle is in danger of distortion or breakage. The damaged needle must be replaced by a new one. Replacement of a needle and point is time-consuming work. If the linking operation is performed with a damaged needle, the quality of product will be reduced. Normally factories have several types of machines to fit varying types and sizes of yarn. If a machine having a fine point is applied to roughly stitched hose, the loops are likely to disengage from the point, and accordingly, the operator must press the hose toward the point by hand. This is difficult work, requiring a high degree of experience and skill. A further disadvantage of conventional linking machines is the difficulty of feeding knit hose to the point of the machine. This difficulty makes it necessary to employ an arranger to feed the knit hose placed flat in orderly condition. However, owing to the existence of this device, a difficulty is likely to arise when the hose are drawn upright and initiate their sectorial motion toward the point, in that both shoulders of the toe portion tend to lower below its middle portion whereby the shoulder portions remain unstitched.

OBJECTS OF THE INVENTION

It is an object of the present invention to provide a method and apparatus for feeding circularly knit hose in an upright position from start to end during which the open ends of these hose are closed by linking, thereby dispensing with the employment of a point.

SUMMARY OF THE INVENTION

According to an aspect of the invention, there is provided a method of closing the toes of hosiery by linking, comprising feeding circular knit hose in a suspended position with a toe portion on top, removing odds and ends of the toe portions thereby to align end lines of the toe portions, closing the toe portions individually by first linking stitches, and covering the first linking stitches by second linking stitches.

According to a feature of the invention, there is provided an apparatus for closing the toes of hosiery by linking, comprising a conveyor, catching means in the conveyor for holding said knit hose in a suspended position with a toe portion of each hose on top, cutter means located along the conveyor for removing odds and ends of the toe portions protruding beyond the catching means thereby to align end lines of the toe portions, first linking means located along the conveyor for closing the toe portions by first linking stitches, and second linking means located subsequently to the first linking means for covering the first linking stitches with second linking stitches.

According to another feature of the invention, there is provided an apparatus for closing toe portions in hose comprising means for suspending the hose with the toe portions on top, means for cutting the toe portions whereby odds and ends thereof are removed, first means for closing the toe portions with first linking stitches, second means for closing the toe portions with second linking stitches over the first linking stitches, and means for sequentially conveying the hose to the means for cutting, the first means for closing and the second means for closing.

The above, and other objects, features and advantages of the present invention, will become apparent from the following description read in conjunction with the accompanying drawings in which like reference numerals designate the same elements.

DETAILED DESCRIPTION OF THE INVENTION

Figure 1:
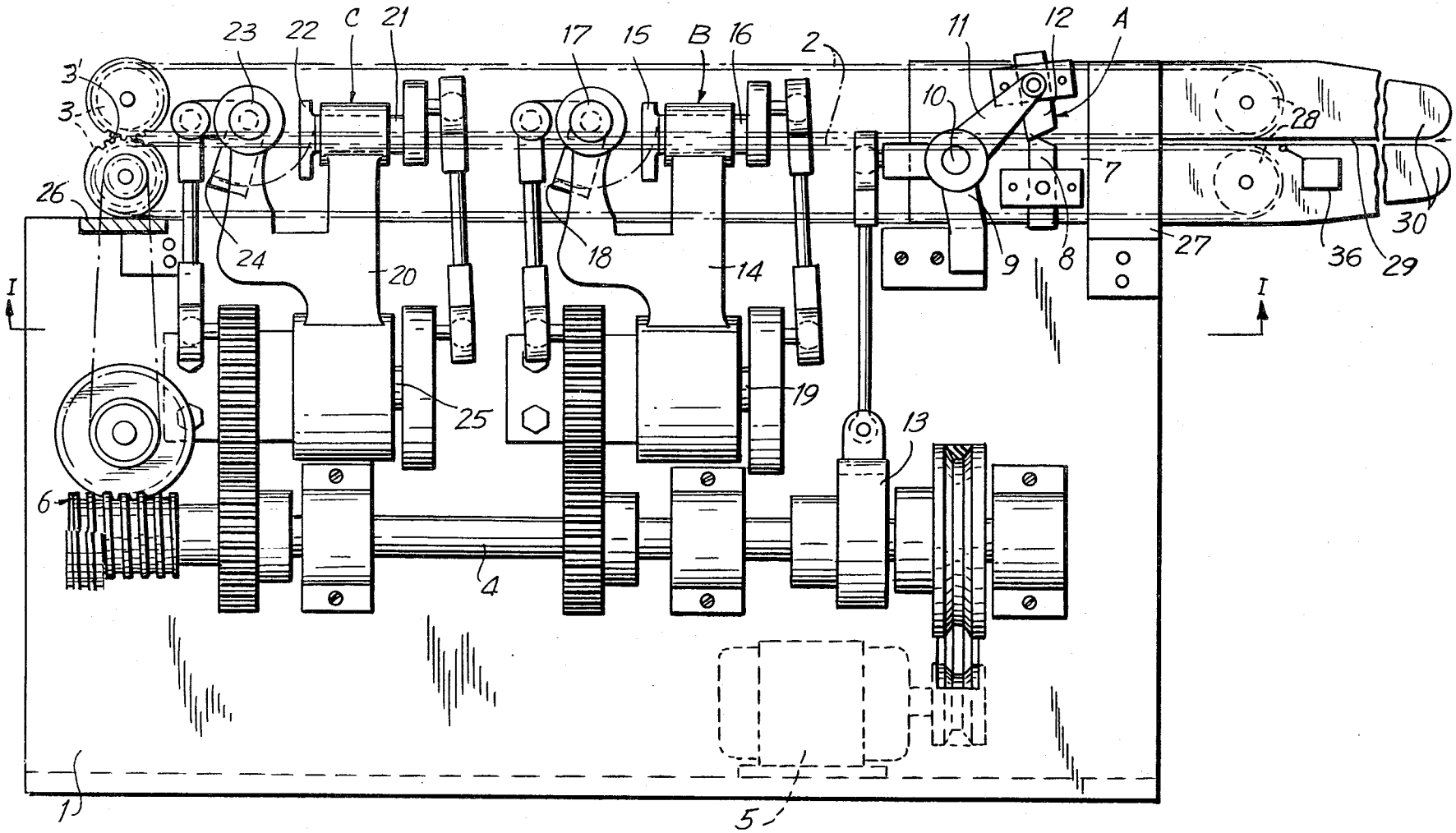
FIG. 1 is a plan view showing an apparatus embodying the present invention.
Figure 2:
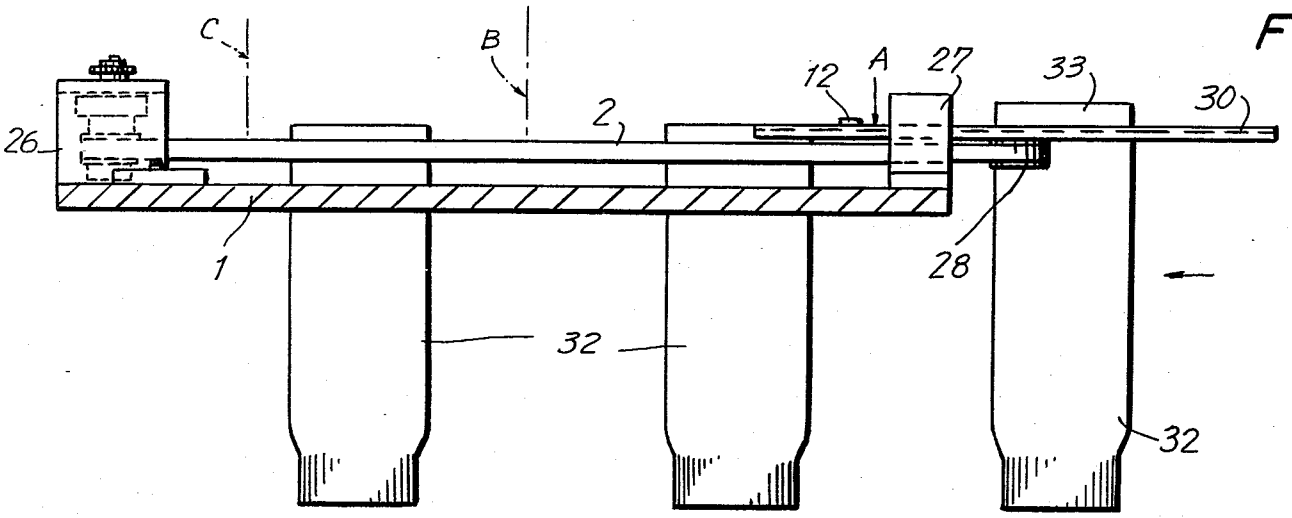
FIG. 2 is a partial sectional view through the apparatus in FIG. 1, taken along the line I—I therein.
Figure 5:
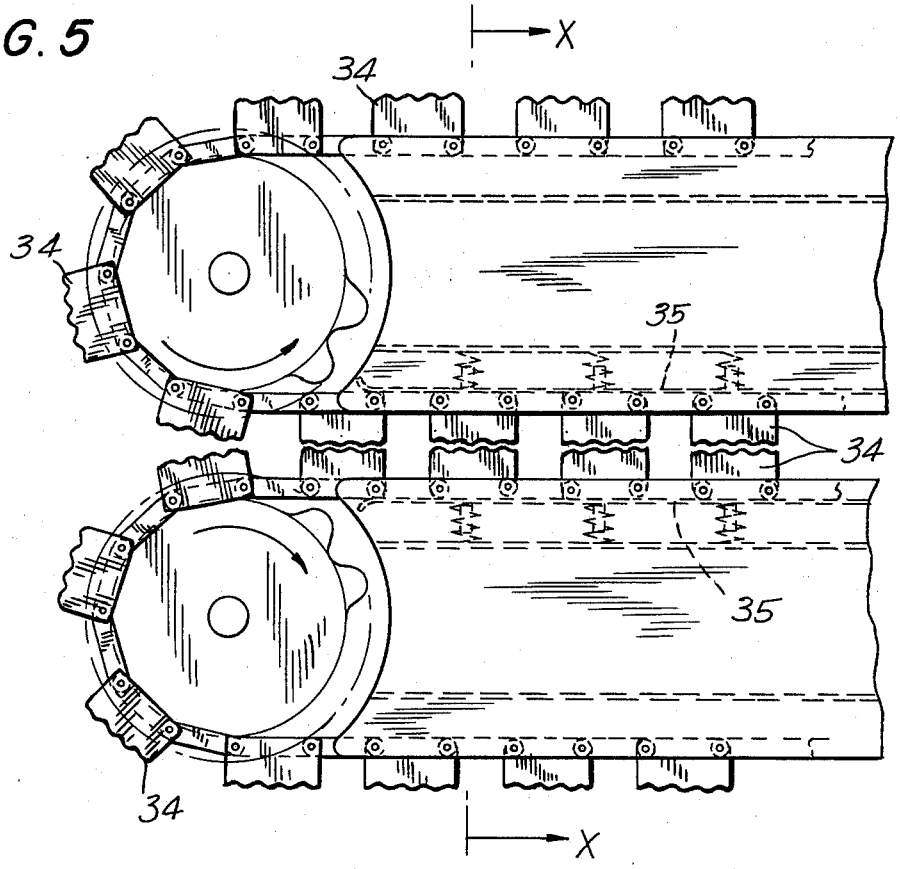
FIG. 5 is a plan view showing a further preferred embodiment of the present invention.
Figure 6:
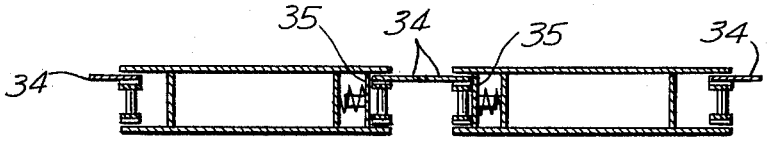
FIG. 6 is a sectional view through the apparatus in FIG. 5, taken along the line X—X.

Referring to FIG. 1, table 1 provides a base for the apparatus. At a side of table 1 a pair of endless belts 2 run at the same speed in the same direction (in FIG. 1, from right to left). on pulleys 3 and 28. Pulleys 3 are driven by an electric motor 5 through a main shaft 4, and a worm gearing 6. To ensure that belts 2 run at the same speed, it is preferred that they have teeth (not shown) of the same pitch at equal interval on each inner surface while pulleys 3 have teeth 3' engageable with the teeth on endless belts 2. The pair of endless belts 2 are spaced to allow inserted knit hose 32 to be held suspended therebetween, as seen in FIG. 2. In order to maintain the space adequately between endless belts 2, it is preferred that an appropriate number of tension rollers (not shown) be mounted on the return run of each endless belt 2 so as to push thereon from behind. In addition, endless belts 2 can be provided with a rough outer surface to prevent the hose from slipping off. Instead of endless belts 2, endless chain trains (not shown) can be employed, on which a number of upright needles (not shown) are preferably provided. Alternatively, as illustrated in FIGS. 5 and 6, each link of the chain trains can be provided with a toothed holder 34, wherein the chain trains are backed up by pushing plates 35 subjecting to a pushing urge provided by spring from behind.

Figure 3:
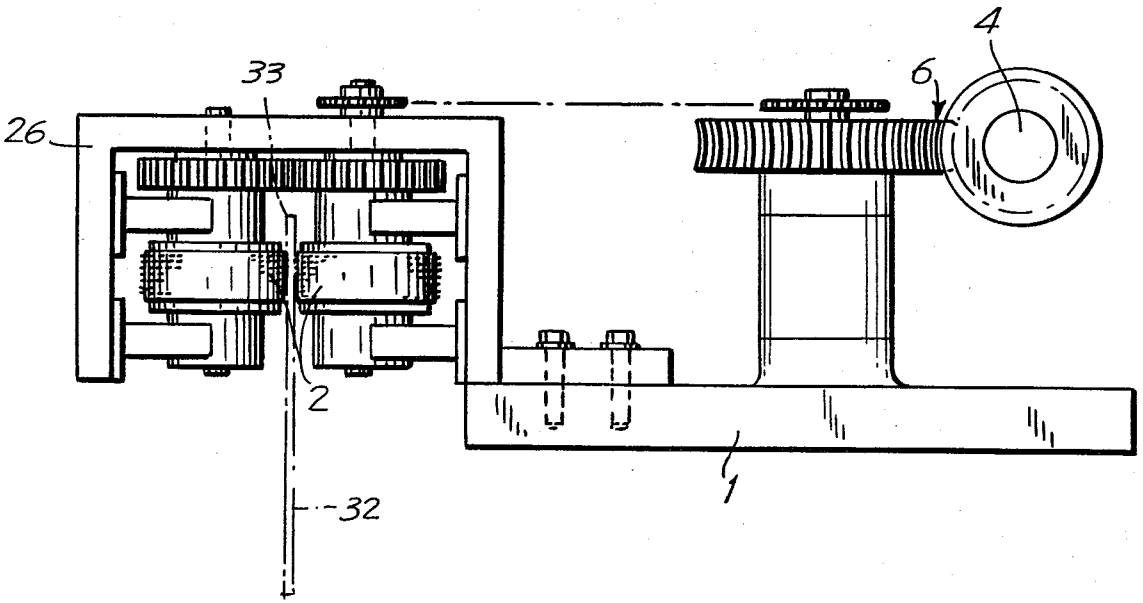
FIG. 3 is a left side view on an enlarged scale of the apparatus in FIG. 1.

Referring again to FIG. 1, the apparatus includes three stations A, B and C. Station a contains a cutter unit consisting of a fixed blade 8 and a movable blade 12 carried on a swinging arm 11 connected to a shaft 10 rotatably supported on a bracket 9 fastened to table 1. Rotary shaft 10 is rotated by means of an eccentric cam plate 13 fastened to main shaft 4. Alternatively, instead of employing eccentric cam plate 13, a pair of spiral gears in mesh (not shown) can be employed, wherein a connecting rod is eccentrically provided on the end face of the driven spiral gear for transmitting the motion of the driven gear to swinging arm 11. Station B is the first linking unit at which the toe of a hose is closed by first linking stitches. Station B includes a bracket 14 fastened to table 1, a shaft 16 horizontally pased through bracket, a first looper supporter 15 rotated by means of shaft 16, and a second looper supporter 18 carried on a rotary shaft 17, wherein loopers per se are not shown. Conventional loopers can be employed. Shafts 16 and 17 are reciprocally rotated in the clockwise or counterclockwise directions by a crank mechanism 19 driven by electric motor 5 through main shaft 4 and known link mechanisms not numbered in the drawings. Station C is the second linking unit at which the already stitched toe of the hose is further stitched with linking stitches in a section slightly below the first linking stitches. Second linking station C has the same structure as first linking station B, and is operated in the same manner by means of electric motor 5. A detailed description of the structure will be omitted. A bracket 26 supports driving pulleys 3. A bracket 27 supports a pair of guide plates 30. Opposed pulleys 28 are carried on guide plates 30 as best illustrated in FIG. 2. Guide plates 30 are spacedly supported to allow inserted knit hose 32 to be beld in a space 29, as best illustrated in FIG. 3 with an upper portion 33 extending thereabove.

Figure 4:
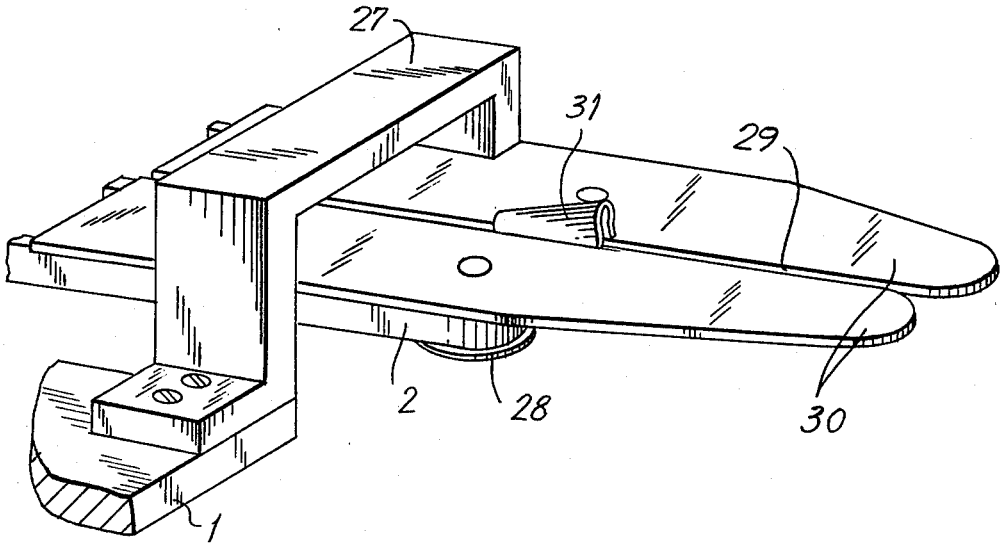
FIG. 4 is a perspective view showing a preferred embodiment of the present invention.

FIG. 4 shows a preferred embodiment which includes a guide member 31 bridging guide plates 30, Guide member 31 is adapted to align the toes of inserted hose so as to dispense with the necessity for waste knitting in the toe portion of the hose. This saves raw material. A limit switch 36 (FIG. 1) can be provided to energize electric motor 5 in response to the feeding of knit hose.

In operation, knit hose are successively supplied from a knitting machine (not shown), and are inserted in space 29 between guide plates 30 with their toe portions on top, as illustrated in FIG. 2. The hose are advanced along endless belts 2 or chain trains in the direction indicated by the arrow in FIGS. 1 and 2. At station A the toe portions 33 (FIG. 3) of hose 32 (i.e. the odds and ends of the toe portions) are cut thereby to align the end lines of the hose. At station B the toe portions are individually closed by linking or looping. The hose continue to advance to station C where the stitched toe portion is further linked in a section slightly below the first stitched part, such that the second linking stitches cover the first linking stitches. In this way the open ends of the hose are closed by double stitches. Finally, the end closed hose are discharged from the conveyor as finished hosiery.

As evident from the foregoing, the open ends of hose are readily closed by linking without the necessity for a high degree of experience and skill as required by conventional methods. In addition, production speed is remarkably increased, thereby leading to labor saving and reduced production cost.

Having described specific preferred embodiments of the invention with reference to the accompanying drawings, it is to be understood that the invention is not limited to those precise ebodiments, and that various changes and modifications may be effected therein by one skilled in the art without departing from the scope or spirit of the invention as defined in the appended claims.

What is claimed is:

1. A method of closing the toe portion of hosiery comprising:

feeding a circular knit hose in a vertical position with said toe portion on top;

gripping opposed sides of said circular knit hose between first and second opposed elements of an endless conveying device with an upward extending portion of said toe portion extending thereabove;

transferring said circular knit hose gripped in said endless conveying device in a continuous linear motion past first, second and third stations;

removing odds and ends of an upper distal part including odds and ends of said upward extending portion in said first station, and leaving a shortened upward extending portion extending above said endless conveying device;

closing said shortened upward extending portion in said second station with first linking stitches;

stitching said upward extending portion in said third station with second linking stitches which cover said first linking stitches; and then discharging said circular knit hose from said endless conveying device.

2. A method according to claim 1 wherein the step of gripping includes resiliently urging opposed elements of said first and second opposed elements whereby said circular knit hose is firmly held.

3. A method according to claim 1 wherein the step of feeding includes;

sliding said circular knit hose along a horizontal gap between guide plates;

vertically aligning a position of said circular knit hose in said gap before the step of gripping.

4. A method according to claim 1 further comprising synchronizing said endless conveying device and said first, second and third stations.

* * * * *